US006289624B1

(12) United States Patent
Hughes et al.

(10) Patent No.: US 6,289,624 B1
(45) Date of Patent: Sep. 18, 2001

(54) LASER BORE SIGHT DEVICE AND METHOD

(75) Inventors: Jeffrey T. Hughes; Christopher R. Rogers, both of Winston Salem; Jimmy R. Saintsing, Thomasville; Gordon S. Severt, Winston Salem, all of NC (US)

(73) Assignee: Hughes Product Company, Inc., Thomasville, NC (US)

( * ) Notice: Subject to any disclaimer, the term of this patent is extended or adjusted under 35 U.S.C. 154(b) by 0 days.

(21) Appl. No.: 09/510,992

(22) Filed: Feb. 22, 2000

(51) Int. Cl.[7] ..... F41G 1/46
(52) U.S. Cl. ..... 42/100; 42/116
(58) Field of Search ..... 42/100, 101, 102, 42/103, 114, 115, 116, 134, 135

(56) References Cited

U.S. PATENT DOCUMENTS 3,112,567 * 12/1963 Flanagan .
4,750,269 * 6/1988 Townsend et al. .
4,825,258 * 4/1989 Whitson .
5,150,527 * 9/1992 Knoster .
5,432,598 * 7/1995 Szatkowski .
5,446,535 * 8/1995 Williams .
5,448,834 * 9/1995 Huang .
5,454,168 * 10/1995 Langner .

OTHER PUBLICATIONS

LASERLYTE BORE ALIGNMENT KIT advertisement (http://store.yahoo.com/sportsmansguide/lasboralkit.html.*
APPLIED LASER INTERNET CATALOG (http://www.appliedlaser.com).*
LASERLYTE BORE ALIGNMENT KIT Advertisement (http://www.tackletogo.com).*
Laserlyte Bore Alignment Kit brochure, 1 page (undated).
Lasermate Corporation specification letter, 1 page, dated Oct. 20, 1999.

* cited by examiner

*Primary Examiner*—Michael J. Carone
*Assistant Examiner*—Troy Chambers

(57) ABSTRACT

A laser bore sight and method for a gun such as a rifle is provided which includes a mandrel with a laser affixed and an arbor for threadably receiving the mandrel. The arbor has a slotted conical well and a threaded shaft in communication therewith so that tightening the mandrel into the arbor will expand the outer diameter of the arbor to hold it firmly within the bore of the gun barrel while it is being sighted. To remove the laser bore sight the mandrel is rotated in an opposite direction and the arbor and mandrel are then easily removed.

15 Claims, 4 Drawing Sheets

LASER BORE SIGHT DEVICE AND METHOD

FIELD OF THE INVENTION

The invention herein pertains to devices for sighting guns and particularly pertains to laser sighting devices as are used with rifles.

DESCRIPTION OF THE PRIOR ART AND OBJECTIVES OF THE INVENTION

As laser beams are generally considered to travel in a straight line it is desirable to use lasers for aligning gun sights for bullet paths and other trajectories. Kits are currently available for placing a relatively low power, short wave length laser into the bore of a rifle barrel which is then pointed at a target. The gun sights can then be adjusted accordingly. Such prior laser devices generally employ a slotted, expandable arbor which, at one end threadably receives a laser containing mandrel. The other or opposite end of the arbor, distal of the mandrel includes a threaded adjusting member which is turned before insertion into the gun barrel to cause the arbor to expand to closely fit the gun barrel bore. However, if the adjusting member is overly tightened, the arbor expands too much and cannot be placed within the barrel. If the threaded member is tightened less than the optimum, then there is "play" between the arbor and the gun barrel, creating an inaccurate or distorted sighting. It has been difficult, even by experienced users to accurately expand the arbor to its optimum before insertion, and satisfactory arbor expansion is only obtained after many attempts, as the arbor must be removed for adjustment purposes.

Thus, with the known problems and disadvantages of prior art laser gun sighting alignment devices, the present invention was conceived and one of its objectives is to provide a laser bore sight device which is easy to properly install in a gun barrel.

It is yet another objective of the present invention to provide a laser bore sight device for a gun which allows the user to readily secure and adjust the device while in the bore of the gun barrel.

It is still yet another objective of the present invention to provide a method for sighting a gun which utilizes a laser bore sight device having an arbor containing a conically-shaped well in communication with a threaded shaft for receiving a mandrel stud.

Various other objectives and advantages of the present invention will become apparent to those skilled in the art as a more detailed description is set forth below.

SUMMARY OF THE INVENTION

The aforesaid and other objectives are realized by providing a mandrel containing a battery operated laser and which includes a threaded stud at the end opposite the laser. The threaded stud is received within a slotted conical shaped well within a polymeric arbor. A threaded shaft communicates with the conical well. By tightening the mandrel into the arbor threaded shaft by turning the mandrel in a clockwise direction, the slotted arbor expands radially for frictionally securing the arbor in a gun barrel bore after the arbor is initially placed therein.

The method of use employs placing the arbor with the mandrel attached into the bore of a rifle barrel and, thereafter by rotating the mandrel in a clockwise direction relative to the arbor, the arbor expands and is securely positioned therein. The rifle can then be pointed at a target and the laser activated. The gun sights are then adjusted to coincide with the laser beam to insure shooting accuracy. In order to remove the device from the gun barrel the mandrel is rotated in a counter-clockwise direction relative to the arbor, allowing the arbor to contract radially, whereby the arbor and mandrel can then easily be slidably removed.

BRIEF DESCRIPTION OF THE DRAWINGS

Schematically representations of the invention are demonstrated as follows.

DESCRIPTION OF THE PREFERRED EMBODIMENTS AND OPERATION OF THE INVENTION

Figures 1, 6:
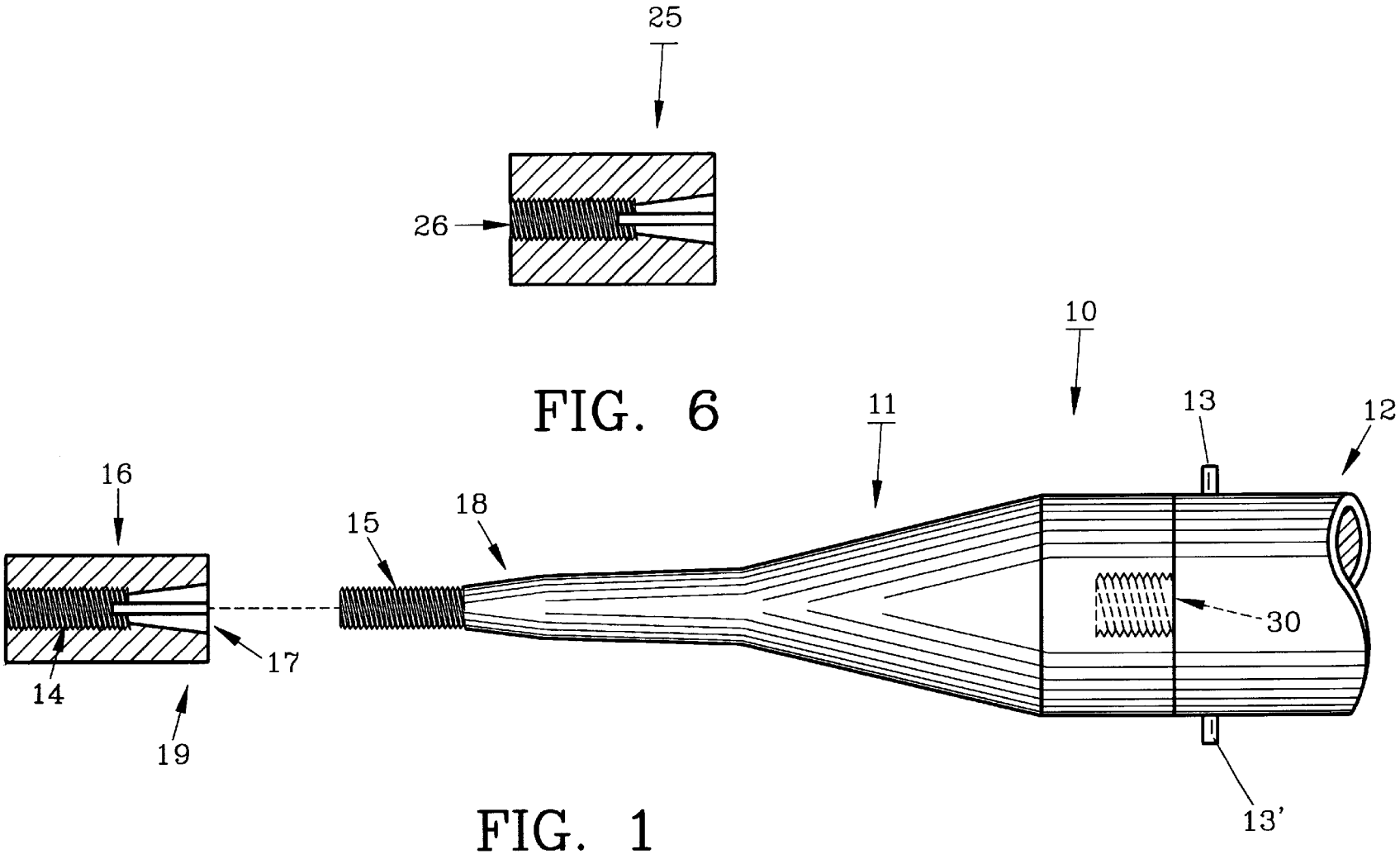
FIG. 1 illustrates an arbor for a small bore rifle removed from the mandrel and laser (shown fragmented)
FIG. 6 shows a cross-sectional view of an arbor having a bore size greater than the arbor shown in FIG. 3.
Figure 5:
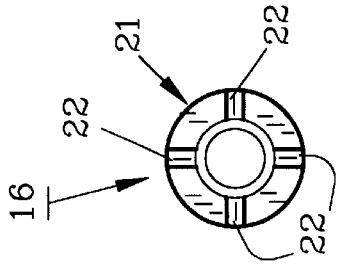
FIG. 5 demonstrates a proximal end view of the arbor shown in FIG. 3 along lines 5—5.
Figure 3:
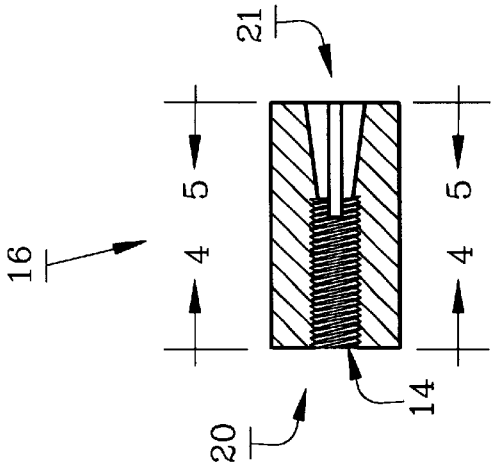
FIG. 3 depicts a cross-sectional view of the arbor as shown in FIG.
Figure 4:
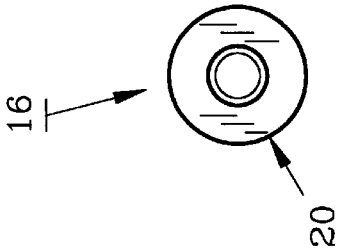
FIG. 4 features a distal end view of the arbor of FIG. 3 along lines 4—4 thereof.
Figure 2:
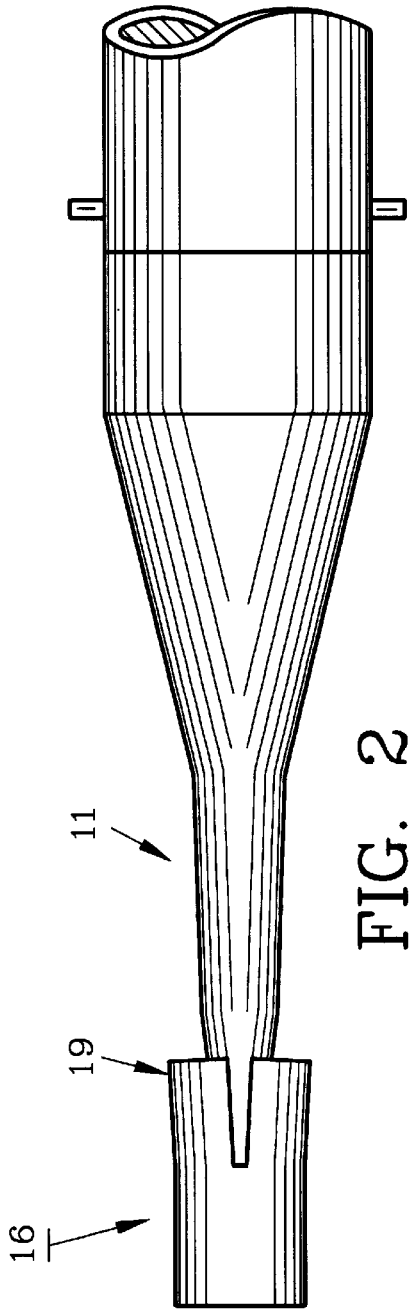
FIG. 2 shows the mandrel of FIG. 1 in position threadably received within the arbor and with the arbor somewhat expanded.

For a better understanding of the invention and its operation, turning now to the drawings, in FIG. 1, preferred laser bore sight device 10 for a gun such as a 0.22 caliber rifle is shown whereby mandrel 11 is threadably joined to a conventional five milliwatt laser 12 (shown fragmented in FIG. 1) which is operated by switches 13, 13'. Mandrel 11 includes threaded stud 15 which is tightenable into threaded shaft 14 of slotted arbor 16 (shown in cross section) which may be formed from polystyrene, polyethylene or other suitable polymeric materials. As further shown in FIG. 1, arbor 16 includes conically shaped well 17 in communication with threaded shaft 14 for receiving threaded stud 15 of mandrel 11. Thus, due to the conical outer surface 18 of mandrel 11, as mandrel 11 is tightened into arbor 16 by rotating in a clockwise direction, slotted arbor 16 will expand and open as shown in FIG. 2 thereby increasing in diameter along its slotted portion indicated generally by arrow 19. In FIG. 3, slotted arbor 16 is shown in cross-sectional view removed from mandrel 11. Distal end 20 of arbor 16 in FIG. 4 is seen with a single opening therein whereas proximal end 21 in FIG. 5 includes four longitudinal slots 22 which allow arbor 16 to expand as further shown in FIG. 2.

As would be understood, various calibers of rifles and pistols may be sighted from time to time and therefore various size arbors such as arbor 25 shown in cross section in FIG. 6 for a larger rifle bore is seen. Threaded shaft 26 of arbor 25 is sized to also receive threaded stud 15 of mandrel

11 although the outer diameter of arbor 25 is greater than the diameter of arbor 16.

Figure 7:
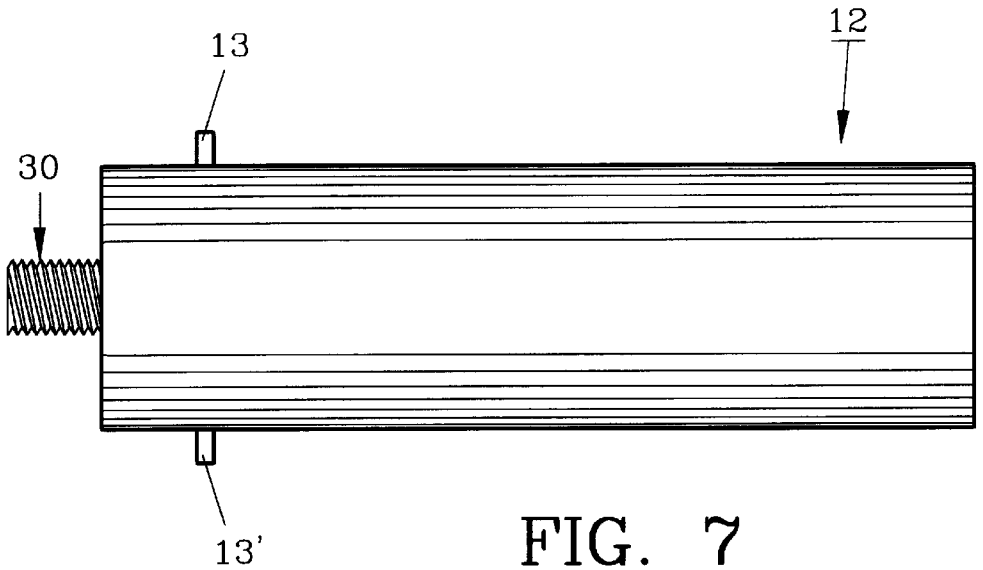
FIG. 7 pictures an elevational view of a conventional bore sight laser.

Standard laser 12 as shown in FIG. 1 is seen in an elevational view in FIG. 7 and includes threaded stud 30 which is received by mandrel 12 as shown in FIG. 1.

Figure 8:
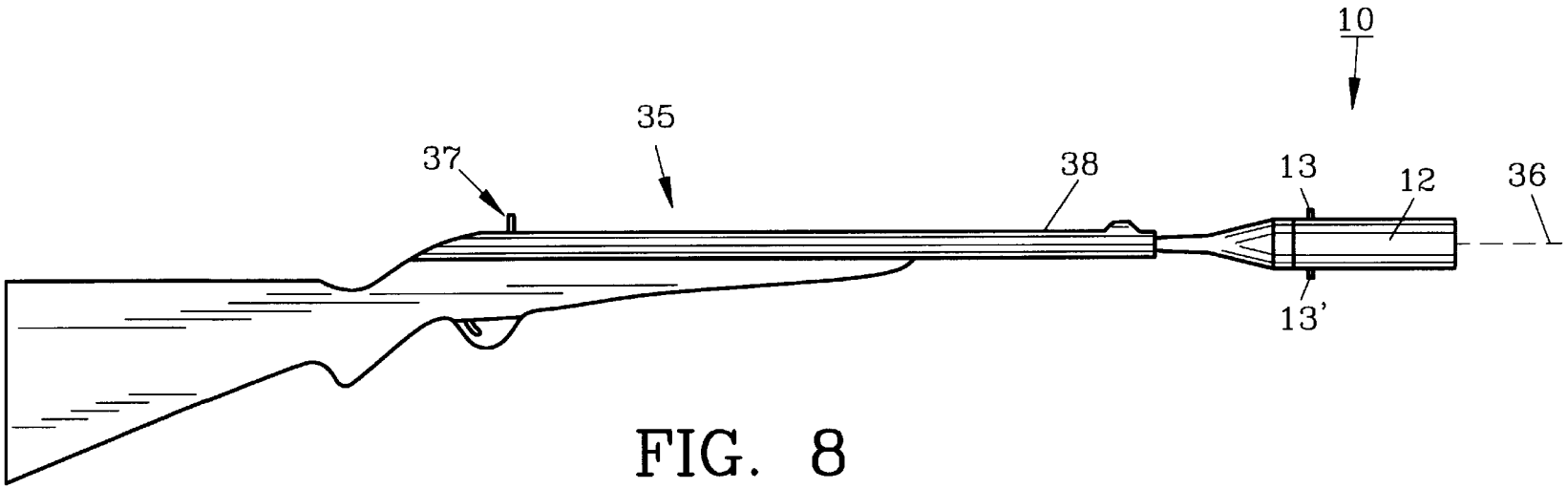
FIG. 8 depicts the bore sight device of the invention positioned within the barrel of a gun.

In FIG. 8 a typical rifle 35 is seen with laser bore sight device 10 in place. Rifle 35 can then be mounted on a stand or otherwise for sighting and laser 12 activated by switch 13, 13'. Laser beam 36 is then positioned in the center of a target and gun sight 37 is then adjusted accordingly. In this manner the trajectory of a bullet from rifle 35 will coincide with the center of the selected target in accordance with the position of laser beam 36.

Figure 10:
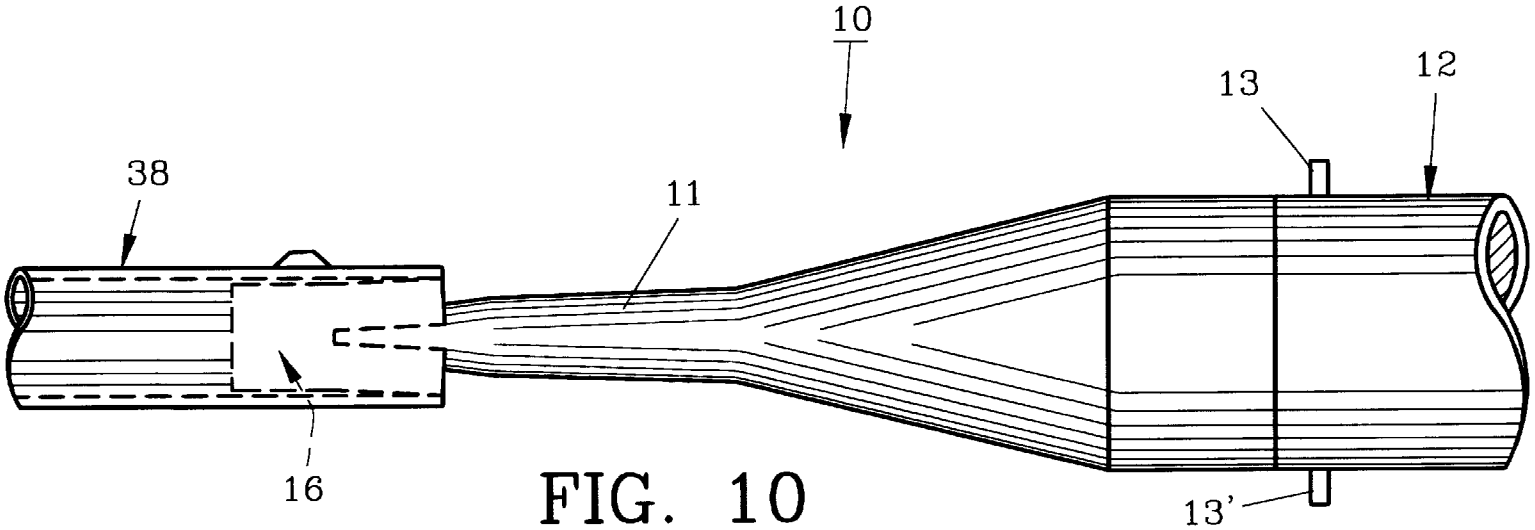
FIG. 10 illustrates the laser device of FIG. 9 but with the arbor expanded and fitting tightly within the gun barrel bore.
Figure 9:
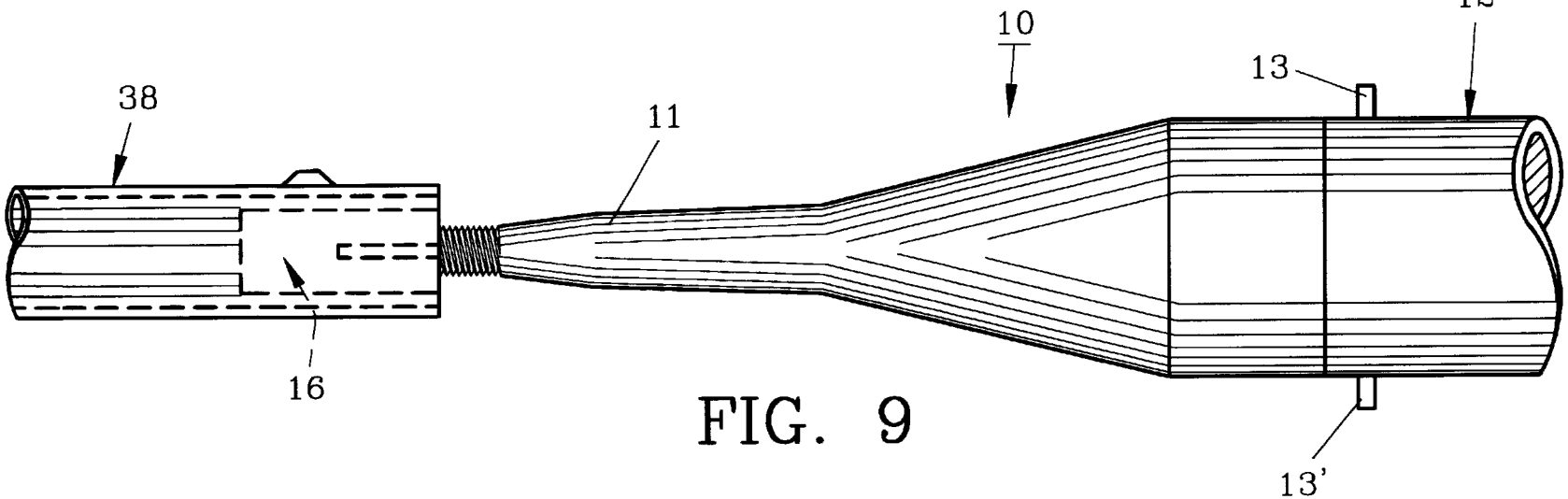
FIG. 9 demonstrates the laser device of the invention in a gun barrel (shown fragmented) prior to expansion of the arbor.

In the preferred method of use, laser bore sight device 10 is placed in barrel 38 of rifle 35, as shown in FIG. 9, with an arbor such as arbor 16 of a diameter to easily slide therein with clearance as shown in FIG. 9. Before sighting the rifle begins, mandrel 11 is tightened into arbor 16 by turning mandrel 11 in a clockwise direction causing slotted arbor 16 to expand and frictionally engage the inner walls of the bore of rifle barrel 38 as seen in FIG. 10. With arbor 16 so expanded, the sighting process on a target then begins. Once sighting and sight adjustments as explained above have been completed, mandrel 11 is rotated in a counterclockwise direction, thus causing arbor 16 to decrease in diameter from its expanded size whereupon laser bore sight device 10 is then easily removed from barrel 38.

The illustrations and examples provided herein are for explanatory purposes and are not intended to limit the scope of the appended claims.

What is claimed is:

1. A laser bore sight for a gun comprising: a mandrel, a laser, said laser contained within said mandrel, an arbor for placement within a gun barrel, said arbor defining a conical well, said mandrel threadably received within said arbor for expanding the same after insertion.

2. The laser bore sight for a gun as claimed in claim 1 wherein said conical well comprising an inner wall, said wall being biased at least seven degrees.

3. The laser bore sight for a gun as claimed in claim 1 wherein said mandrel includes a threaded stud.

4. The laser bore sight for a gun as claimed in claim 1 wherein said laser comprises a five milliwatt laser for operation at 650 mm.

5. The laser bore sight for a gun as claimed in claim 1 wherein said laser comprises a switch.

6. The laser bore sight for a gun as claimed in claim 1 further comprising a threaded stud, said threaded stud for connection to said mandrel.

7. The laser bore sight for a gun as claimed in claim 1 wherein said arbor defines a longitudinal slot.

8. The laser bore sight for a gun as claimed in claim 1 wherein said arbor is formed from a polymeric material.

9. The laser bore sight for a gun as claimed in claim 1 wherein said arbor is sized to fit a twenty-two caliber barrel.

10. A method of sighting a gun comprising the steps of:

a) placing an expandable arbor with a conically-shaped well and a threaded shaft into a gun barrel;

b) threading a conically shaped mandrel with a laser into the arbor to expand the arbor while within the gun barrel; and c) sighting the gun with the laser.

11. The method of claim 10 wherein placing an arbor within a gun barrel comprises the step of sliding the arbor into the gun barrel.

12. The method of claim 10 wherein threading a mandrel into the arbor comprises the step of rotating the mandrel in a clockwise direction relative to the arbor.

13. The method of claim 10 wherein sighting the gun comprises the step of activating the laser to direct the laser beam onto a target.

14. The method of claim 10 further comprising the step of decreasing the diameter of the arbor before removing the arbor from the gun barrel.

15. A method of utilizing a laser for sighting a gun comprising the steps of:

a) threading a mandrel containing a laser into a conical well of a selected arbor;

b) sliding the arbor with the attached mandrel into a gun barrel;

c) rotating the mandrel relative to the arbor to expand the arbor after insertion into the gun barrel; and d) activating the laser to sight the gun.

* * * * *